US007815758B2

(12) United States Patent
Benedictus et al.

(10) Patent No.: US 7,815,758 B2
(45) **Date of Patent: *Oct. 19, 2010**

(54) HIGH DAMAGE TOLERANT AL-CU ALLOY

(75) Inventors: Rinze Benedictus, Delft (NL); Christian Joachim Keidel, Montabaur (DE); Alfred Ludwig Heinz, Niederahr (DE); Alfred Johann Peter Haszler, Vallendar (DE)

(73) Assignee: Aleris Aluminum Koblenz GmbH, Koblenz (DE)

( * ) Notice: Subject to any disclaimer, the term of this patent is extended or adjusted under 35 U.S.C. 154(b) by 222 days.

This patent is subject to a terminal disclaimer.

(21) Appl. No.: 11/948,614

(22) Filed: Nov. 30, 2007

(65) Prior Publication Data

US 2008/0121317 A1 May 29, 2008

Related U.S. Application Data

(62) Division of application No. 10/642,507, filed on Aug. 18, 2003, now Pat. No. 7,323,068.

(30) Foreign Application Priority Data

Aug. 20, 2002 (EP) ..... 02078443

(51) Int. Cl.
*C22F 1/057* (2006.01)

(52) U.S. Cl. ..... 148/552; 148/693; 148/700

(58) Field of Classification Search ..... 148/552, 148/693, 694, 700
See application file for complete search history.

(56) References Cited

U.S. PATENT DOCUMENTS

| | | | |
|---|---|---|---|
| 3,826,688 | A | 7/1974 | Levy |
| 4,294,625 | A | 10/1981 | Hyatt et al. |
| 4,336,075 | A | 6/1982 | Quist et al. |
| 5,213,639 | A | 5/1993 | Colvin et al. |

(Continued)

FOREIGN PATENT DOCUMENTS

CA 2 349 793 A1 12/2001

(Continued)

OTHER PUBLICATIONS

Metals Handbook Desk Edition, ASM International, 1999, p. 1037.

(Continued)

*Primary Examiner*—Roy King
*Assistant Examiner*—Janelle Morillo
(74) *Attorney, Agent, or Firm*—Novak Druce + Quigg LLP

(57) ABSTRACT

Disclosed is a high damage tolerant Al—Cu alloy of the AA2000 series having a high toughness and an improved fatigue crack growth resistance, including the following composition (in weight percent) Cu 3.8-4.7, Mg 1.0-1.6, Zr 0.06-0.18, Cr<0.15, Mn>0-0.50, Fe≦0.15, Si≦0.15, and Mn-containing dispersoids, the balance essentially aluminum and incidental elements and impurities, wherein the Mn-containing dispersoids are at least partially replaced by Zr-containing dispersoids. There is also disclosed a method for producing a rolled high damage tolerant Al—Cu alloy product having a high toughness and an improved fatigue crack growth resistance, and applications of that product as a structural member of an aircraft.

22 Claims, 2 Drawing Sheets

U.S. PATENT DOCUMENTS

| | | | | |
|---|---|---|---|---|
| 5,376,192 | A | 12/1994 | Cassada, III | |
| 5,593,516 | A | 1/1997 | Cassada, III | |
| 5,620,652 | A | 4/1997 | Tack et al. | |
| 5,759,302 | A | 6/1998 | Nakai et al. | |
| 5,863,359 | A | 1/1999 | Karabin et al. | |
| 5,865,914 | A | 2/1999 | Karabin et al. | |
| 5,879,475 | A | 3/1999 | Karabin | |
| 5,897,720 | A | 4/1999 | Dorward | |
| 5,938,867 | A | 8/1999 | Dorward et al. | |
| 6,077,363 | A * | 6/2000 | Heymes et al. | 148/417 |
| 6,277,219 | B1 | 8/2001 | Heinz et al. | |
| 6,325,869 | B1 | 12/2001 | Liu et al. | |
| 6,562,154 | B1 * | 5/2003 | Rioja et al. | 148/415 |
| 6,569,542 | B2 | 5/2003 | Warner et al. | |
| 6,602,361 | B2 | 8/2003 | Warner et al. | |
| 6,974,633 | B2 | 12/2005 | Garratt et al. | |
| 7,323,068 | B2 | 1/2008 | Benedictus et al. | |
| 7,494,552 | B2 | 2/2009 | Benedictus et al. | |
| 7,604,704 | B2 * | 10/2009 | Benedictus et al. | 148/417 |
| 2001/0006082 | A1 | 7/2001 | Warner et al. | |
| 2002/0014288 | A1 | 2/2002 | Warner et al. | |
| 2002/0031681 | A1 | 3/2002 | Heinz et al. | |
| 2003/0070734 | A1 | 4/2003 | Heinz et al. | |
| 2003/0104990 | A1 | 6/2003 | Hauer et al. | |
| 2003/0140990 | A1 | 7/2003 | Ribes et al. | |
| 2004/0060618 | A1 | 4/2004 | Benedictus et al. | |
| 2004/0079455 | A1 | 4/2004 | Dif et al. | |
| 2004/0099353 | A1 | 5/2004 | Benedictus et al. | |
| 2004/0112480 | A1 | 6/2004 | Benedictus et al. | |
| 2007/0000583 | A1 | 1/2007 | Rioja et al. | |

FOREIGN PATENT DOCUMENTS

| | | |
|---|---|---|
| EP | 0473122 | 3/1992 |
| EP | 0489408 | 6/1992 |
| EP | 0723033 | 7/1996 |
| EP | 0731185 | 9/1996 |
| EP | 0989195 | 3/2000 |
| EP | 1045043 | 10/2000 |
| EP | 1114877 | 7/2001 |
| EP | 1170394 | 1/2002 |
| EP | 1026270 | 2/2002 |
| FR | 2789405 | 8/2000 |
| GB | 2352453 | 1/2001 |
| JP | 60067636 | 4/1985 |
| JP | 60251260 | 12/1985 |
| JP | 7252574 | 3/1995 |
| JP | 10017976 | 1/1998 |
| WO | 00 37702 | 6/2000 |
| WO | 2004 018723 | 3/2004 |

OTHER PUBLICATIONS

J.R. Davis, "Metals Handbook—Desk Edition," p. 427 (2000).

J.R. Davis, "ASM Specialty Handbook—Aluminium and Aluminium Alloys," ASM Int'l, pp. 63-64, 143-47 (1993).

J.R. Davis, "ASM Specialty Handbook—Aluminium and Aluminium Alloys," ASM Int'l, Paper No. XP-002266795, p. 20 (1996).

J.R. Davis, "ASM Specialty Handbook—Aluminium-Lithium Alloys," p. 121 (May, 1994).

N. Ridley and J. Pilling, "Superplastic deformation characteristics of some commercial aluminium alloys," Aluminium Technology, London, Book 3, Session B, pp. 44.1-44.7 (Mar. 1986).

"ASM Handbook: vol. 2, Properties and Selection: Nonferrous Alloys and Special-Purpose Materials," ASM Int'l, pp. 70-79 (1990).

"ASM Handbook: vol. 9, Metallography and Microstructures," ASM Int'l, pp. 364-365 (1985).

ASTM E112-96, Standard Test Methods for Determining Average Grain Size (1996).

ASM Specialty Handbook, Aluminum and Aluminum Alloys, p. 29-30 (1993).

New Materials for Next Generation Commercial Transports, National Materials Advisory Board, National Academy Press, p. 26 (1996).

Metals Handbook Desk Edition: 2nd ed., ASM International, 1998, pp. 445-446.

* cited by examiner

HIGH DAMAGE TOLERANT AL-CU ALLOY

CROSS REFERENCE TO RELATED APPLICATION

This is a divisional application claiming priority under 35 USC §120 from U.S. patent application Ser. No. 10/642,507 filed Aug. 18, 2003, now U.S. Pat. No. 7,323,068, incorporated herein by reference in its entirety, which claims priority from European patent application number 02078443.5 filed Aug. 20, 2002.

FIELD OF THE INVENTION

The present invention relates to a high damage tolerant Al—Cu alloy product having a high toughness and an improved fatigue crack growth resistance while maintaining good strength levels, to a method for producing such a rolled high damage tolerant Al—Cu alloy product having a high toughness and an improved fatigue crack growth resistance and further to a rolled alloy sheet product for aeronautical applications. More specifically, the present invention relates to a high damage tolerant Al—Cu—Mg alloy designated by the Aluminum Association ("AA")2xxx-series for structural aeronautical applications with improved properties such as fatigue crack growth resistance, strength and fracture toughness. The invention also relates to a rolled alloy product which is suitable used as fuselage skin or lower wing skin of an aircraft.

BACKGROUND OF THE INVENTION

It is known in the art to use heat treatable aluminum alloys in a number of applications involving relatively high strength such as aircraft fuselages, vehicular members and other applications. The aluminum alloys 2024, 2324 and 2524 are well known heat treatable aluminum alloys which have useful strength and toughness properties in T3, T39 and T351 tempers.

The design of a commercial aircraft requires various properties for different types of structures on the aircraft. Especially for fuselage skin or lower wing skin it is necessary to have properties such as good resistance to crack propagation either in the form of fracture toughness or fatigue crack growth. At the same time the strength of the alloy should not be reduced. A rolled alloy product either used as a sheet or as a plate with an improved damage tolerance will improve the safety of the passengers, will reduce the weight of the aircraft and thereby improve the fuel economy which translates to a longer flight range, lower costs and less frequent maintenance intervals.

It is known in the art to have AA2×24 alloy compositions with the following broad compositional range, in weight percent:

Cu: 3.7-4.4
Mg: 1.2-1.8
Mn: 0.15-0.9
Cr: 0.05-0.10
Si: ≦0.50
Fe: ≦0.50
Zn: ≦0.25
Ti: ≦0.15
the balance aluminum and incidental impurities.

U.S. Pat. No. 5,593,516 discloses a high damage tolerant Al—Cu alloy with a balanced chemistry comprising essentially the following composition (in weight %):

Cu: 2.5-5.5
Mg: 0.1-2.3
$Cu_{max}$: −0.91 Mg+5.59
$Cu_{min}$: −0.91 Mg+4.59
Zr: up to 0.2, or
Mn: up to 0.8
balance aluminum and unavoidable impurities. It also discloses T6 and T8 tempers of such alloys which gives high strength to a rolled product made of such alloy.

U.S. Pat. No. 5,897,720 discloses a high damage tolerant Al—Cu alloy with a "2024"-chemistry comprising essentially the following composition (in weight %):

Cu: 3.8-4.9
Mg: 1.2-1.8
Mn: 0.3-0.9
the balance aluminum and unavoidable impurities wherein the alloy is annealed after hot rolling at a temperature at which the intermetallics do not substantially dissolve. The annealing temperature is between 398° C. and 455° C.

U.S. Pat. No. 5,938,867 discloses a high damage tolerant Al—Cu alloy with a "2024"-chemistry comprising essentially the following composition (in weight %):

Cu: 3.8-4.9
Mg: 1.2-1.8
Mn: 0.3-0.9
balance aluminum and unavoidable impurities wherein the ingot is inter-annealed after hot rolling with an anneal temperature of between 385° C. and 468° C.

EP-0473122, as well as U.S. Pat. No. 5,213,639, disclose an aluminum base alloy comprising essentially the following composition (in weight %):

Cu: 3.8-4.5, preferably 4.0-4.5
Mg: 1.2-1.8, preferably 1.2-1.5
Mn: 0.3-0.9, preferably 0.4-0.7
Fe: ≦0.12
Si: ≦0.10.
the remainder aluminum, incidental elements and impurities, wherein such aluminum base is hot rolled, heated and again hot rolled, thereby obtaining good combinations of strength together with high fracture toughness and a low fatigue crack growth rate. More specifically, U.S. Pat. No. 5,213,639 discloses an inter-anneal treatment after hot rolling the cast ingot with a temperature between 479° C. and 524° C. and again hot rolling the inter-annealed alloy wherein the alloy contains one or more elements from the group consisting of Cr, V, Hf, Cr, Ag and Sc, each within defined ranges. Such alloy is reported to have a 5% improvement over the above mentioned conventional 2024-alloy in T-L fracture toughness and an improved fatigue crack growth resistance at certain ΔK-levels.

EP-1170394-A2 discloses an aluminum sheet product with improved fatigue crack growth resistance having an anisotropic microstructure defined by grains having an average length to width aspect ratio of greater than about 4 to 1 and comprising essentially the following composition, (in weight %):

Cu: 3.5-4.5
Mg: 0.6-1.6
Mn: 0.3-0.7
Zr: 0.08-0.13,
the remainder substantially aluminum, incidental elements and impurities. The examples show a Zr-level in the range of 0.10 to 0.12 while maintaining an Mg-level of more than 1.30. Such alloy has an improvement in compressive yield strength properties which is achieved by respective sheet products in comparison with conventional 2524-sheet products. Furthermore, the strength and toughness combinations of such sheet products with high Mn variants have been described better than those of 2524-T3. Throughout the high anisotropy in grain structure the fatigue crack growth resistance could be improved.

Furthermore, it is described that low copper-high manganese samples exhibited higher properties than high copper-low manganese samples. Results from tensile strength measurements showed that high manganese variants exhibited higher strength values than the low manganese variants. The strengthening effect of manganese was reported to be surprisingly higher than that of copper.

SUMMARY OF THE INVENTION

It is a preferred object of the present invention to provide a high damage tolerant 2024-series type alloy rolled product having a high toughness and an improved fatigue crack growth resistance while maintaining good strength levels of conventional 2024, 2324 or 2524 alloys. It is another preferred object of the present invention to provide an aluminum alloy sheet product having an improved fracture toughness and resistance to fatigue crack growth for aircraft applications such as fuselage skin or lower-wing skin.

Yet a further preferred object of the present invention is to provide rolled aluminum alloy sheet products and a method for producing those products so as to provide structural members for aircrafts which have an increased resistance to fatigue crack growth and to provide an improved fracture toughness while still maintaining high levels of strength.

More specifically, there is a general requirement for rolled AA2000-series aluminum alloys within the range of 2024 and 2524 alloys when used for aeronautical applications that the fatigue crack growth rate ("FCGR") should not be greater than a defined maximum. A FCGR which meets the requirements of high damage tolerance 2024-series alloy products is, e.g., FCGR below 0.001 mm/cycles at $\Delta K=20$ MPa$\sqrt{m}$ and 0.01 mm/cycles at $\Delta K=40$ MPa$\sqrt{m}$.

The present invention preferably solves one or more of the above mentioned objects.

BRIEF DESCRIPTION OF THE DRAWINGS

The foregoing and other features and advantages of the alloy according to the invention will become readily apparent from the following detailed description of preferred embodiments. Some of the enhanced high damage tolerant properties are shown in the appended drawings, in which.

DETAILED DESCRIPTION OF THE PREFERRED EMBODIMENTS

Figure 1:
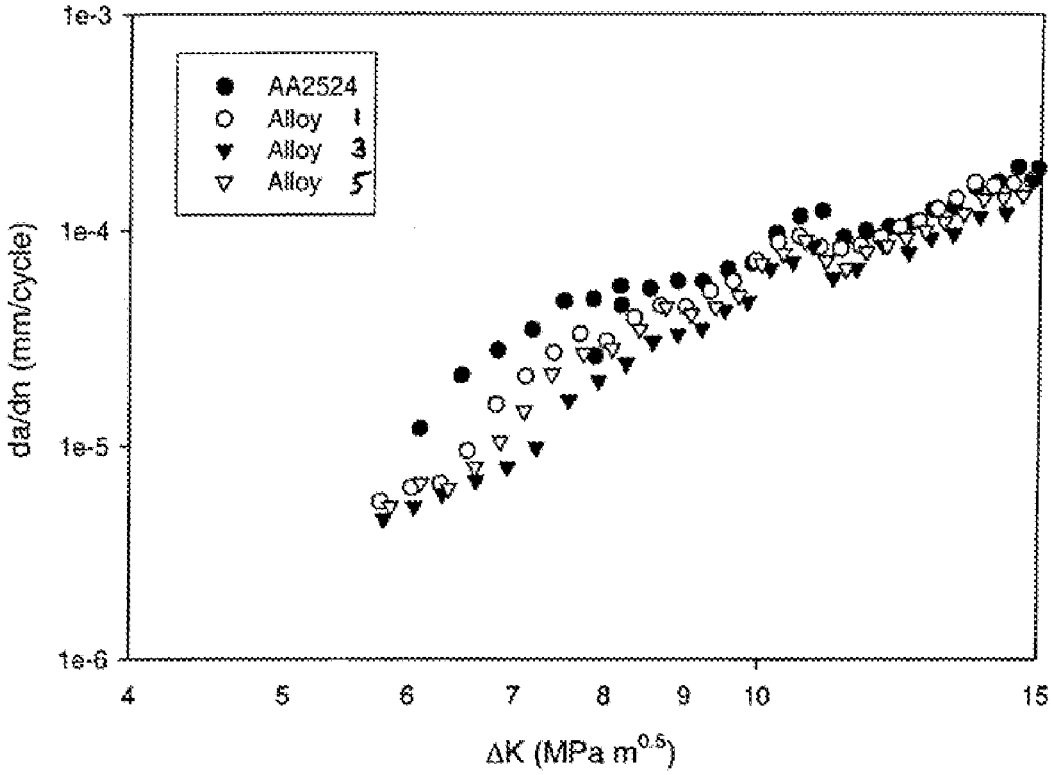
FIG. 1 shows the fatigue crack growth properties versus a 2524 reference alloy.

In accordance with the invention there is disclosed a high damage tolerant Al—Cu alloy having a high toughness and an improved fatigue crack growth resistance by maintaining high levels of strength which comprises essentially the following composition (in weight %):

Cu: 3.8-4.7
Mg: 1.0-1.6
Zr: 0.06-0.18
Mn: >0-0.50, and preferably >0.15-0.50
Cr: <0.15
Fe: ≦0.15, preferably ≦0.10
Si: ≦0.15, preferably ≦0.10,
and Mn-containing dispersoids and Zr-containing dispersoids, the balance essentially aluminum and incidental elements and impurities, wherein the Mn-containing dispersoids are at least partially replaced by Zr-containing dispersoids. The alloy contains Mn-containing dispersoids and Zr-containing dispersoids.

It has surprisingly been found that lower levels of manganese result in a high toughness and an improved fatigue crack growth resistance specifically in areas where the toughness and fatigue crack growth resistance under tensile load are critical. The alloy of the instant invention in a T3 temper has significant improved high damage tolerance properties by lowering the amount of manganese and by partially replacing manganese-containing dispersoids by zirconium containing dispersoids. At the same time it is important to carefully control the chemistry of the alloy.

The main improvement of the alloy according to the present invention is an improved fatigue crack growth resistance at the lower $\Delta K$-values which leads to significant longer lifetimes. The balance of high damage tolerance properties and mechanical properties of the alloy of the present invention is better than the balance of conventional 2024 or 2524-T3 alloys. At the same time the toughness levels are equal or better to 2524 alloy levels. It has been found that the high damage tolerance properties such as fracture toughness or strength may be further improved by adding zirconium.

The amount (in weight %) of manganese is preferably in a range of 0.20 to 0.45%, most preferably in a range of 0.25 to 0.30%. Mn contributes to or aids in grain size control during operations. The preferred levels of manganese are lower than those conventionally used in conventional AA2×24 alloys while still resulting in sufficient strength and improved damage tolerance properties. In order to optimize the improved high damage tolerance properties the chemical composition of the alloy of the present invention preferably meets the proviso that Zr≧0.09 when Mn≦0.45 and Cu≧4.0.

The amount (in weight %) of copper is in a range of 4.0 to 4.4, preferably in a range of 4.1 to 4.3. Copper is an important element for adding strength to the alloy rolled product. It has been found that a copper content of 4.1 or 4.2 results in a good compromise in strength, toughness, formability and corrosion performance while still resulting in sufficient damage tolerance properties.

The preferred amount (in weight %) of magnesium is in a range of 1.0 to 1.4, most preferably in a range of 1.1 to 1.3. Magnesium provides also strength to the alloy rolled product.

The preferred amount (in weight %) of zirconium is in a range of 0.09 to 0.15 thereby partially replacing Mn-containing dispersoids. The balance of manganese and zirconium influences the recrystallisation behavior. Throughout the addition of zirconium more elongated grains may be obtained which also results in an improved fatigue crack growth resistance. Zirconium may also be at least partially replaced by chromium wherein [Zr]+[Cr]≦0.20. Preferred amounts (in weight %) of chromium and zirconium are in a range of 0.05 to 0.15, preferably in a range of 0.10 to 0.13. The balance of zirconium and chromium as well as the partial replacement of Mn-containing dispersoids and Zr-containing dispersoids result in an improved recrystallisation behavior and more elongated grains.

A preferred alloy composition of the present invention comprises the following composition (in weight %):

Cu: 4.0-4.2
Mn: 0.20-0.50

Mg: 1.0-1.3.

Another preferred alloy according to the present invention consists of the following composition (in weight %):

Cu: 4.0-4.2
Mg: about 1.2
Zr: 0.10-0.15
Mn: 0.20-0.50
Fe: ≦0.10
Si: ≦0.10.

Even more preferred, an alloy according to the present invention consists of the following composition (in weight %):

Cu: 4.1 or 4.2
Mg: about 1.2
Zr: about 0.14
Mn: 0.20-0.50
Fe: ≦0.10
Si: ≦0.10.

The balance in the rolled alloy product according to the invention is aluminum and inevitable impurities and incidental elements. Typically, each impurity element is present at 0.05% maximum and the total of impurities is 0.20% maximum. Preferably the alloy product is substantially Ag-free. The best results are achieved when the alloy rolled products have a recrystallised microstructure meaning that 75% or more, and preferably more than 80% of the grains in a T3 temper, e.g. T39 or T351, are recrystallised. In a further aspect of the microstructure it has the grains have an average length to width aspect ratio of smaller than about 4 to 1, and typically smaller than about 3 to 1, and more preferably smaller than about 2 to 1. Observations of these grains may be done, for example, by optical microscopy at 50× to 100× in properly polished and etched samples observed through the thickness in the longitudinal orientation.

The alloy according to the present invention may further comprise one or more of the elements Zn, Hf, V, Sc, Ti or Li, the total amount less than 1.00 (in weight %). These additional elements may be added to further improve the balance of the chemistry and enhance the forming of dispersoids.

In another aspect the invention provides a method for producing a rolled high damage tolerant Al—Cu alloy product having a composition as set out above and having a high toughness and an improved fatigue crack growth resistance according to the invention comprises the steps of:

a) casting an ingot having a composition as set out above and set forth in the claims,
b) homogenizing and/or pre-heating the ingot after casting,
c) hot rolling the ingot and optionally cold rolling into a rolled product,
d) solution heat treating,
e) quenching the heat treated product,
f) stretching the quenched product, and
g) naturally ageing the rolled and heat-treated product.

After hot rolling the ingot it is possible to anneal and/or re-heat the hot rolled ingot and again hot rolling the rolled ingot. It is believed that such re-heating or annealing enhances the fatigue crack growth resistance by producing elongated grains which—when recrystallized—maintain a high level of toughness and good strength. It is furthermore possible to conduct a surface heat treatment between hot rolling and cold rolling at the same temperatures and times as during homogenisation, e.g. 1 to 5 hours at 460° C. and about 24 hours at 490° C. The hot rolled ingot is preferably inter-annealed before and/or during cold rolling to further enhance the ordering of the grains. Such inter-annealing is preferably done at a gauge of about 4.0 mm for one hour at 350° C. Furthermore, it is advisable to stretch the rolled and heat-treated product in a range of 1 to 5%, preferably in a range of 1 to 3%, and then naturally aging the stretched product for more than 5 days, preferably about 10 to 20 days, and more preferably for 10 to 15 days, to provide a T3 temper condition, in particular a T351 temper condition.

The present invention provides a high damage tolerant rolled Al—Cu alloy sheet product which has high toughness and an improved fatigue crack growth resistance with the above described alloy composition which is preferably produced in accordance with the above described method. Such rolled alloy sheet product has preferably a gauge of around 2.0 mm to 12 mm for applications such as fuselage skin and about 25 mm to 50 mm for applications such as lower-wing skin. The present invention thereby provides an aircraft fuselage sheet or an aircraft lower-wing member sheet with improved high damage tolerance properties. In particular when used as aircraft fuselages, the sheet may be unclad or clad, with preferred cladding layer thickness of from about 1 to about 5 percent of the thickness of the sheet.

Figure 2:
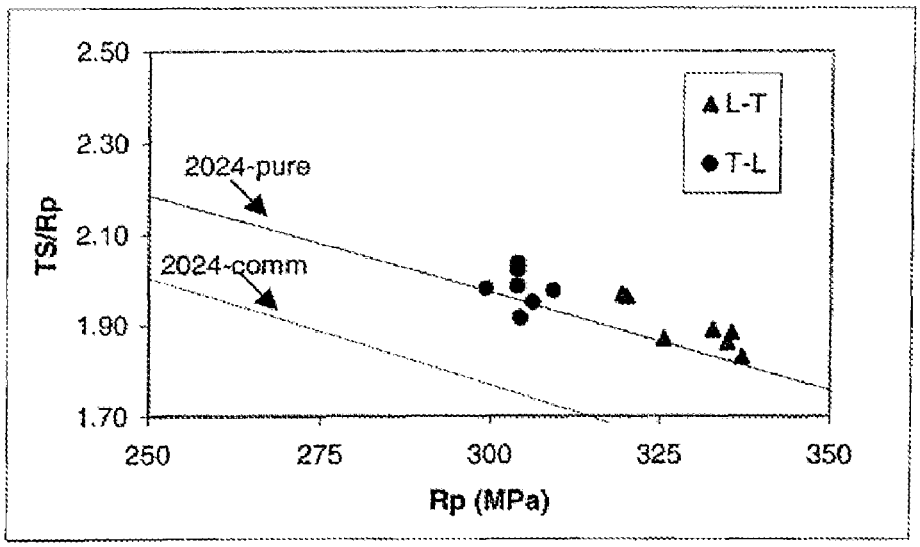
FIG. 2 shows the Kahn-tear versus yield strength properties compared to 2024-T351 commercially available alloys and 2024-T351 pure grade alloys.
Figure 3:
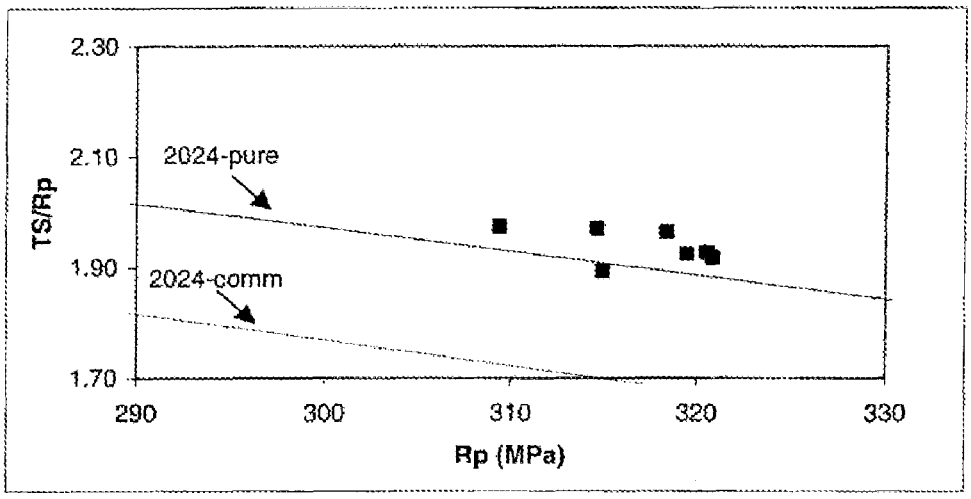
FIG. 3 shows the Kahn-tear versus yield strength properties as shown in FIG. 2 but in average L-T and T-L direction.

The foregoing and other features and advantages of the alloy according to the invention will become readily apparent from the following examples. Some of the enhanced high damage tolerant properties are shown in the appended drawings, in which:

FIG. 1 shows the fatigue crack growth properties versus a 2524 reference alloy; and FIG. 2 shows the Kahn-tear versus yield strength properties compared to 2024-T351 commercially available alloys and 2024-T351 pure grade alloys; and FIG. 3 shows the Kahn-tear versus yield strength properties as shown in FIG. 2 but in average L-T and T-L direction.

Examples

On an industrial scale 7 different aluminum alloys have been cast into ingots having the following chemical composition as set out in Table 1.

TABLE 1

Chemical composition of the DC-cast aluminum alloys, in weight %, Si about 0.05%, Fe about 0.06%, balance aluminum and inevitable impurities.

| | Alloying Element | | | | |
|---|---|---|---|---|---|
| Alloy | Cu | Mn | Mg | Zr | Cr |
| AA2024 | 4.4 | 0.59 | 1.5 | 0 | 0 |
| AA2524 | 4.3 | 0.51 | 1.4 | 0 | 0 |
| 1 | 4.4 | 0.40 | 1.3 | 0.06 | 0 |
| 2 | 4.3 | 0.41 | 1.3 | 0.09 | 0 |
| 3 | 4.2 | 0.43 | 1.2 | 0.14 | 0 |
| 4 | 4.1 | 0.31 | 1.2 | 0.14 | 0 |
| 5 | 4.1 | 0.21 | 1.2 | 0.14 | 0 |
| 6 | 4.4 | 0.21 | 1.4 | 0.10 | 0 |
| 7 | 4.4 | 0.21 | 1.3 | 0 | 0.08 |

The alloys have been processed to a 2.0 mm sheet in the T351 temper. The cast ingots were homogenized at about 490° C., and subsequently hot rolled at about 410° C. The plates were further cold rolled, surface heat treated and stretched by about 1%. All alloys have been tested after at least 10 days of natural aging.

Then the ultimate tensile strength properties and the unit propagation energy as well as the Kahn-tear has been measured in the L and T-L direction. The testing has been done in accordance with ASTM-B871 (1996) for the Kahn tear tests, and EN-10.002 for the tensile tests.

TABLE 2

Tensile properties and toughness of Alloys 1 to 7 of Table 1 in the L and T-L direction.

| Alloy | L PS (MPa) | L UTS (MPa) | L UPE (kJ/m2) | T-L TS/Rp |
|---|---|---|---|---|
| AA2024 | 344 | 465 | 162 | 1.74 |
| AA2524 | 338 | 447 | 331 | 1.99 |
| 1 | 324 | 441 | 355 | 1.92 |
| 2 | 335 | 446 | 294 | 1.95 |
| 3 | 338 | 449 | 322 | 2.02 |
| 4 | 337 | 449 | 335 | 1.98 |
| 5 | 320 | 419 | 335 | 1.98 |
| 6 | 332 | 442 | 266 | 1.91 |
| 7 | 337 | 449 | 289 | 1.92 |

As identified in Table 2 and shown in FIGS. 2 and 3 the Kahn-tear versus yield strength properties of the alloys according to the present invention are better than those of conventional 2024-T351 in commercially available form or pure form. Furthermore, the preferred minimum level of manganese is in between 0.21 and 0.31 while at a level of 0.21 the strength level is still good.

In order to identify the fatigue crack growth rate ("FCGR") all alloys were tested according to ASTM E-647 on 80 mm wide M(T) panels at R=0.1 at constant load and a frequency of 8 Hz. The lifetime as shown in Table 3 is defined as the time (in number of cycles) that the crack grows from a length of 5 mm to 20 mm. The maximum stress was 54 MPa. The initial notch was 4.1 mm. Anti-buckling device are not used. The results are presented in Table 3 and FIG. 1.

From the results of Table 3 and FIG. 1 it can be seen that the preferred amount of Mn is in a range of 0.25 to 0.45 (in weight %) and the preferred range of Zr is in between 0.09 and 0.15 (in weight %). Copper is most preferably present in an amount below 4.3 and magnesium is preferably present in an amount below 1.3 (in weight %).

From the results of Table 3 and according to FIG. 1 (Region A) it can be seen that alloys 3 and 5 have a significantly improved lifetime over conventional AA2024 alloys preferably at ΔK-levels in a range of 5 to 15 MPa√m. Hence, the fatigue crack growth resistance at those lower ΔK-values results in significant longer lifetimes of the alloy and enhances its usefulness for aeronautical applications.

TABLE 3

Fatigue crack growth rate with ΔK-level is MPa√m for all alloys compared with commercially available AA2024 alloy (=baseline).

| Alloy | Cycles between a = 5 and 20 mm | Improvement in lifetime over AA2024 |
|---|---|---|
| AA2024 | 163830 | baseline |
| AA2524 | 216598 | 32% |
| 1 | 338468 | 107% |
| 3 | 526866 | 222% |
| 5 | 416750 | 154% |
| 6 | 272034 | 66% |
| 7 | 284609 | 74% |

Having now fully described the invention, it will be apparent to one of ordinary skill in the art that many changes and modifications can be made without departing from the spirit or scope of the invention as hereon described.

The invention claimed is:

1. A method for producing a rolled high damage tolerant AA2xxx-series alloy product and having a high toughness and an improved fatigue crack growth resistance, comprising the steps of:

a) casting an ingot comprising the following composition (in weight percent):
Cu: 3.8-4.7
Mg: 1.0-1.6
Zr: 0.06-0.18
Mn: >0-0.50
Fe: ≦0.15
Si: ≦0.15,
the balance essentially aluminum and incidental elements and impurities, b) homogenizing and/or pre-heating the ingot after casting, c) hot rolling the ingot and optionally cold rolling into a rolled product, d) solution heat treating, e) quenching the heat treated product, f) stretching in the quenched product, and g) naturally ageing the rolled and heat-treated product to provide a T3 condition; and wherein the alloy product comprises Mn-containing dispersoids and Zr-containing dispersoids, wherein the alloy product has a microstructure wherein the grains have an average length to width aspect ratio of smaller than about 3 to 1.

2. The method according to claim 1, wherein the product is processed to provide a T39 temper condition.

3. The method according to claim 1, wherein the product is processed to provide a T351 temper condition.

4. The method according to claim 1, wherein said alloy product is recrystallized to at least 75%.

5. The method according to claim 1, wherein said alloy product is recrystallized to at least 80%.

6. The method according to claim 1, wherein the amount (in weight %) of Mn of the alloy product is in a range of 0.20 to 0.45%.

7. The method according to claim 1, wherein the amount (in weight %) of Mn of the alloy product is in a range of 0.25 to 0.30%.

8. The method according to claim 1, wherein the amount (in weight %) of Cu is in a range of 4.0 to 4.4%.

9. The method according to claim 1, wherein the amount (in weight %) of Cu is in a range of 4.1 to 4.3%.

10. The method according to claim 1, wherein the amount (in weight %) of Mg is in a range of 1.0 to 1.4%.

11. The method according to claim 1, wherein the alloy product is substantially Ag-free.

12. The method according to claim 1, wherein said alloy further comprises one or more of the elements Zn, Hf, V, Sc, Ti or Li, the total amount less than 1.00 (in weight %).

13. The method according to claim 1, wherein the alloy product has a microstructure wherein the grains have an average length to width aspect ratio of smaller than about 2 to 1.

14. The method according to claim 1, wherein the alloy product has a fatigue crack growth rate of less than 0.001 mm/cycles at ΔK=20 MPa√m when tested according to ASTM-E647 on 80 mm wide M(T) panels at R=0.1 at constant load and at a frequency of 8 Hz.

15. The method according to claim 1, wherein the alloy product has a thickness in a range of 2.0 to 12 mm.

16. The method according to claim 1, wherein the alloy product has a thickness in a range of 25 to 50 mm.

17. The method according to claim 1, wherein the alloy product is processed into a fuselage sheet of an aircraft.

18. The method according to claim 1, wherein the alloy product is processed into a lower-wing member of an aircraft.

19. The method according to claim 1, wherein after hot rolling the ingot, annealing and/or reheating the hot rolled ingot and again hot rolling the rolled ingot.

20. The method according to claim 1, wherein said hot rolled ingot is inter-annealed before and/or during cold rolling.

21. The method according to claim 1, wherein said rolled and heat-treated product is stretched by about 1 to 5% and naturally aged for more than 5 days.

22. The method according to claim 1, wherein said rolled and heat-treated product is stretched by about 1 to 5% and naturally aged for more than 10 days.

* * * * *